US011554593B2

(12) United States Patent
Miyamoto

(10) Patent No.: US 11,554,593 B2
(45) Date of Patent: Jan. 17, 2023

(54) INKJET RECORDING APPARATUS

(71) Applicant: CANON KABUSHIKI KAISHA, Tokyo (JP)

(72) Inventor: Hiroshi Miyamoto, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 33 days.

(21) Appl. No.: 17/366,314

(22) Filed: Jul. 2, 2021

(65) Prior Publication Data

US 2022/0016913 A1 Jan. 20, 2022

(30) Foreign Application Priority Data

Jul. 20, 2020 (JP) ..... JP2020-123994

(51) Int. Cl.
*B41J 11/00* (2006.01)

(52) U.S. Cl.
CPC ..... *B41J 11/0005* (2013.01); *B41J 11/00242* (2021.01)

(58) Field of Classification Search
CPC ..... B41J 11/0005; B41J 11/00242
See application file for complete search history.

(56) References Cited

U.S. PATENT DOCUMENTS

| | | | |
|---|---|---|---|
| 8,827,412 | B2 | 9/2014 | Kanome et al. |
| 2013/0100198 | A1 | 4/2013 | Kanome et al. |
| 2020/0122488 | A1 | 4/2020 | Brinkly et al. |

FOREIGN PATENT DOCUMENTS

| | | | |
|---|---|---|---|
| JP | 2003-167474 | A | 6/2003 |
| JP | 2013-086457 | A | 5/2013 |
| JP | 2013-086476 | A | 5/2013 |
| WO | 2019/013755 | A1 | 1/2019 |

OTHER PUBLICATIONS

Translation of JP 2003-167474 A. (Year: 2003).*

* cited by examiner

*Primary Examiner* — Justin Seo
(74) *Attorney, Agent, or Firm* — Venable LLP

(57) ABSTRACT

An inkjet recording apparatus includes a printing portion configured to discharge ink on a sheet, a drying portion configured to blow warm air to the sheet to dry ink, a first rotary member is in contact with the first surface of the sheet, a heating portion configured to heat the first rotary member, a second rotary member configured to form a nip portion that apply heat and pressure to the sheet, a first detection unit configured to detect a temperature of the first rotary member, a second detection unit configured to detect a temperature of the second rotary member, a cooling unit configured to cool the second rotary member, and a control unit configured to execute a cooling mode of activating the cooling unit in a state where a temperature difference between the first rotary member and the second rotary member is smaller than a threshold.

7 Claims, 8 Drawing Sheets

INKJET RECORDING APPARATUS

BACKGROUND OF THE INVENTION

Field of the Invention

The present invention relates to an inkjet recording apparatus for forming an image on a sheet by discharging ink.

Description of the Related Art

Hitherto, inkjet recording apparatuses for forming images on sheets by discharging ink onto the sheets are provided. An inkjet recording apparatus equipped with a drying unit for drying ink on the sheet to which an image has been printed by ink by blowing warm air to the sheet has been proposed (Japanese Patent Application Laid-Open Publication No. 2013-86457). Further, an inkjet recording apparatus equipped with a sheet heating unit for nipping and conveying a sheet to which an image has been printed by ink while applying heat and pressure to the sheet so as to dry the ink on the sheet has been proposed (WO 2019/013755 A1). The sheet heating unit presses and heats the sheet to which an image has been printed and conveyed in a curled state due to the moisture contained in the ink, thereby drying the ink and straightening the curl of the sheet.

According to the sheet heating unit described above, better curl straightening effect can be achieved if the temperature difference between a heating belt for nipping and conveying a sheet and a pressure roller is high, so that only the heating belt is heated and the pressure roller is not heated. If printing is performed continuously to a plurality of sheets, the pressure roller may be heated and the temperature difference between the heating belt and the pressure roller may be reduced, according to which the curl of the sheet becomes difficult to straighten.

It is possible to adopt both the drying unit and the sheet heating unit, in other words, to blow warm air by the drying unit to the sheet to which an image has been printed, and thereafter, apply heat and pressure to the sheet by the sheet heating unit. However, in such a case, it was difficult to continuously straighten the curl of the sheet. That is, if the drying unit is used in addition to the sheet heating unit, the sheet tends to be curled greatly by the drying of the ink by the drying unit, and in order to straighten such curl, it was necessary to increase the temperature difference between the heating belt and the pressure roller and to maintain such temperature difference. However, the temperature of the pressure roller was easily increased due to the heat of the heating belt and the heating of the sheet whose temperature was raised by the drying unit, and it was difficult to maintain the necessary temperature difference for straightening the curl and to thereby continuously straighten the curl of the sheet.

SUMMARY OF THE INVENTION

According to one aspect of the present invention, an inkjet recording apparatus includes a conveyance portion configured to convey a sheet, a printing portion configured to discharge ink and form an image on a first surface of the sheet, a drying portion configured to blow warm air to the first surface of the sheet to which the image has been formed by the printing portion to dry ink, a first rotary member arranged downstream of the drying portion in a conveyance direction of the sheet and is in contact with the first surface of the sheet, a heating portion configured to heat the first rotary member, a second rotary member abutted against the first rotary member and configured to form a nip portion that is configured to nip and convey the sheet having passed the drying portion and apply heat and pressure to the sheet, a first detection unit configured to detect a temperature of the first rotary member, a second detection unit configured to detect a temperature of the second rotary member, a cooling unit configured to cool the second rotary member, and a control unit configured to execute a cooling mode of activating the cooling unit in a state where a temperature difference between the first rotary member and the second rotary member is smaller than a threshold.

Further features of the present invention will become apparent from the following description of exemplary embodiments with reference to the attached drawings.

DESCRIPTION OF THE EMBODIMENTS

First Embodiment

Inkjet Recording Apparatus

An inkjet recording apparatus according to a present embodiment will be described with reference to the drawings. At first, a schematic configuration of the inkjet recording apparatus according to the present embodiment will be described with reference to FIG. 1. An inkjet recording apparatus 1 illustrated in FIG. 1 includes a printer, a copying machine, a facsimile and a multifunction machine, and forms an image on a sheet P based on image information entered from an external apparatus such as a computer or a document reading apparatus. The sheet P includes paper such as normal paper and thick paper, plastic films such as OHP sheets, special sheets such as envelopes and index paper, and cloths or other sheet materials that can be printed on using ink.

Figure 1:
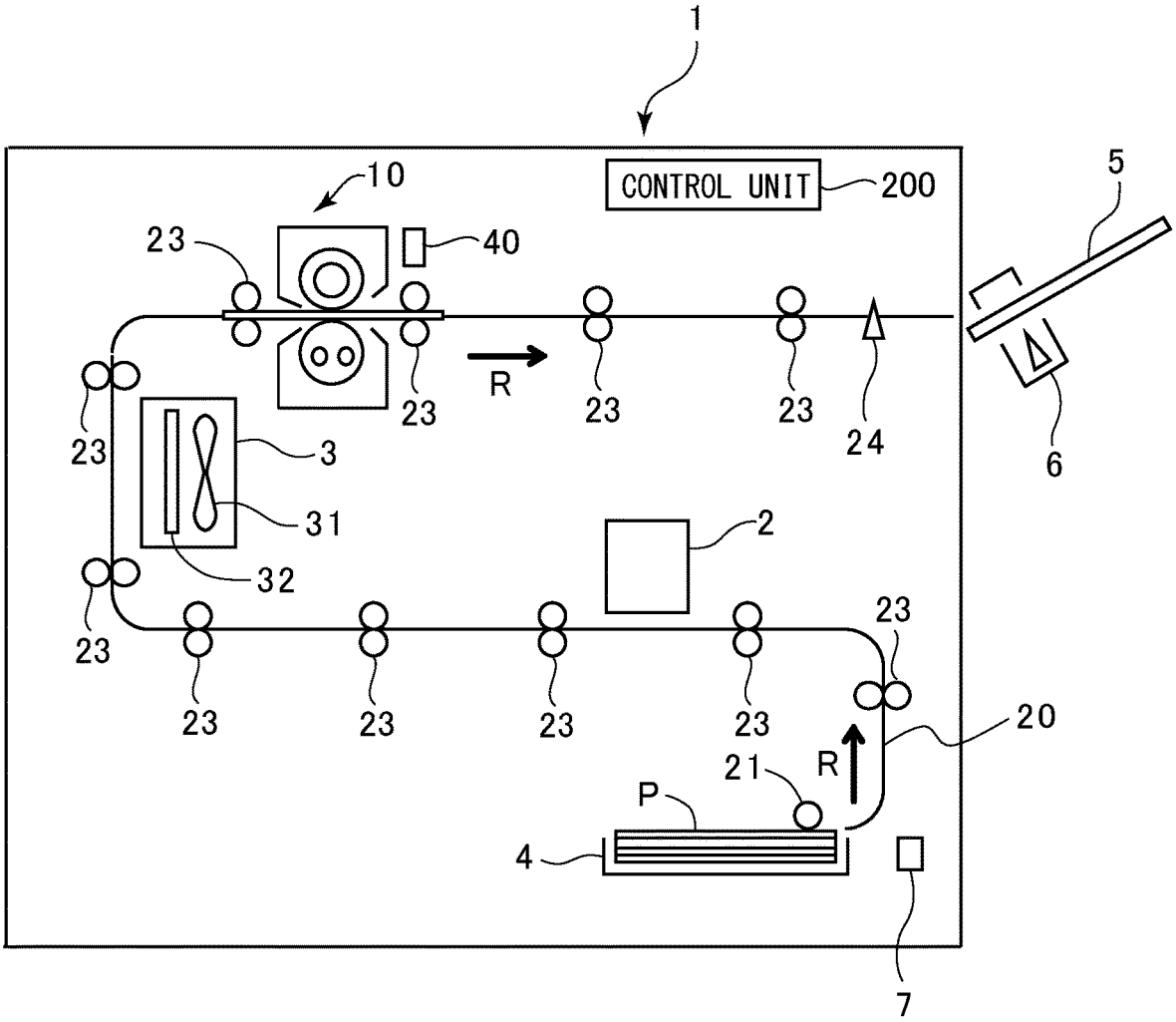
FIG. 1 is a schematic view illustrating an inkjet recording apparatus according to a present embodiment.

As illustrated in FIG. 1, the inkjet recording apparatus 1 according to the present embodiment is an apparatus in which sheets P stored in advance in a sheet storage portion 4 are fed one at a time by a sheet feed roller 21 into a sheet conveyance path 20. Alternatively, the sheet P placed on a manual feed tray not shown can be fed one at a time into the sheet conveyance path 20. The sheet P being fed is conveyed in the sheet conveyance path 20 by a plurality of conveyance roller pairs 23 arranged along the sheet conveyance path 20 toward a conveyance direction, i.e., arrow R direction. The conveyance roller pairs 23 are rotated by a motor not shown. The conveyance portion for conveying the sheet P is not limited to the conveyance roller pairs 23, and it can be a conveyor belt. Further, a temperature and humidity sensor 7 for detecting temperature and relative humidity can be provided in a vicinity of the sheet storage portion 4.

The inkjet recording apparatus 1 includes a printing unit 2, a drying unit 3, a sheet heating unit 10 and a cooling device 40 provided in an apparatus body, which are arranged along the sheet conveyance path 20 in the order from upstream toward downstream in a conveyance direction. The printing unit 2 serving as a printing portion is a unit that forms an image on the sheet P by discharging ink to a first surface of the sheet P conveyed in the sheet conveyance path 20. Although not shown, the printing unit 2 includes a plurality of print heads corresponding to the colors of the inks being used. For example, four print heads are provided in correspondence to four colors, which are yellow (Y), magenta (M), cyan (C) and black (K). The print heads are so-called line type print heads, and a plurality of ink discharge ports (not shown) are aligned in a row along a width direction intersecting a conveyance direction of the sheet P so as to cover a maximum sheet width range of the sheets P to which image can be formed in the inkjet recording apparatus 1.

A method for discharging ink from the print heads can be, for example, a method using heater elements, a method using piezoelectric elements, a method using electrostatic elements, or a method using MEMS elements. Inks of various colors are supplied to the print heads via ink tubes from respective ink tanks not shown.

The sheet P to which an image has been printed on the first surface by the printing unit 2 is conveyed by the conveyance roller pairs 23 to the drying unit 3 arranged downstream in the conveyance direction, and ink is dried by the drying unit 3. The drying unit 3 serving as a drying portion includes a drying fan 31, and a heater 32 for heating the air blown from the drying fan 31 as warm air. The drying unit 3 blows warm air toward the first surface referred to as an image forming surface of the sheet P onto which an image has been formed by ink, and thereby, the ink on the sheet P is dried.

The sheet P having passed the drying unit 3 is conveyed by the conveyance roller pairs 23 to the sheet heating unit 10 arranged downstream in the conveyance direction. The sheet heating unit 10 applies heat and pressure to the sheet P and dries the ink on the sheet P that had not been completely dried by the drying unit 3. Detailed configurations of the sheet heating unit 10 will be described later (refer to FIG. 2).

The sheet P having passed the sheet heating unit 10 is discharged onto a sheet discharge tray 5 attached to an exterior of the apparatus body. According to the present embodiment, a stapling unit 6 is provided on the sheet discharge tray 5 to perform a stapling process to a set of the plurality of sheets P discharged thereto. A sheet detection sensor 24 is arranged in a vicinity of the sheet discharge port to count the number of sheets P that had passed the sheet heating unit 10, that is, that had been discharged to the sheet discharge tray 5, and based on the detection result of the sheet detection sensor 24, the stapling process is performed for each set of a predetermined number of sheets.

Sheet Heating Unit

Figure 2:
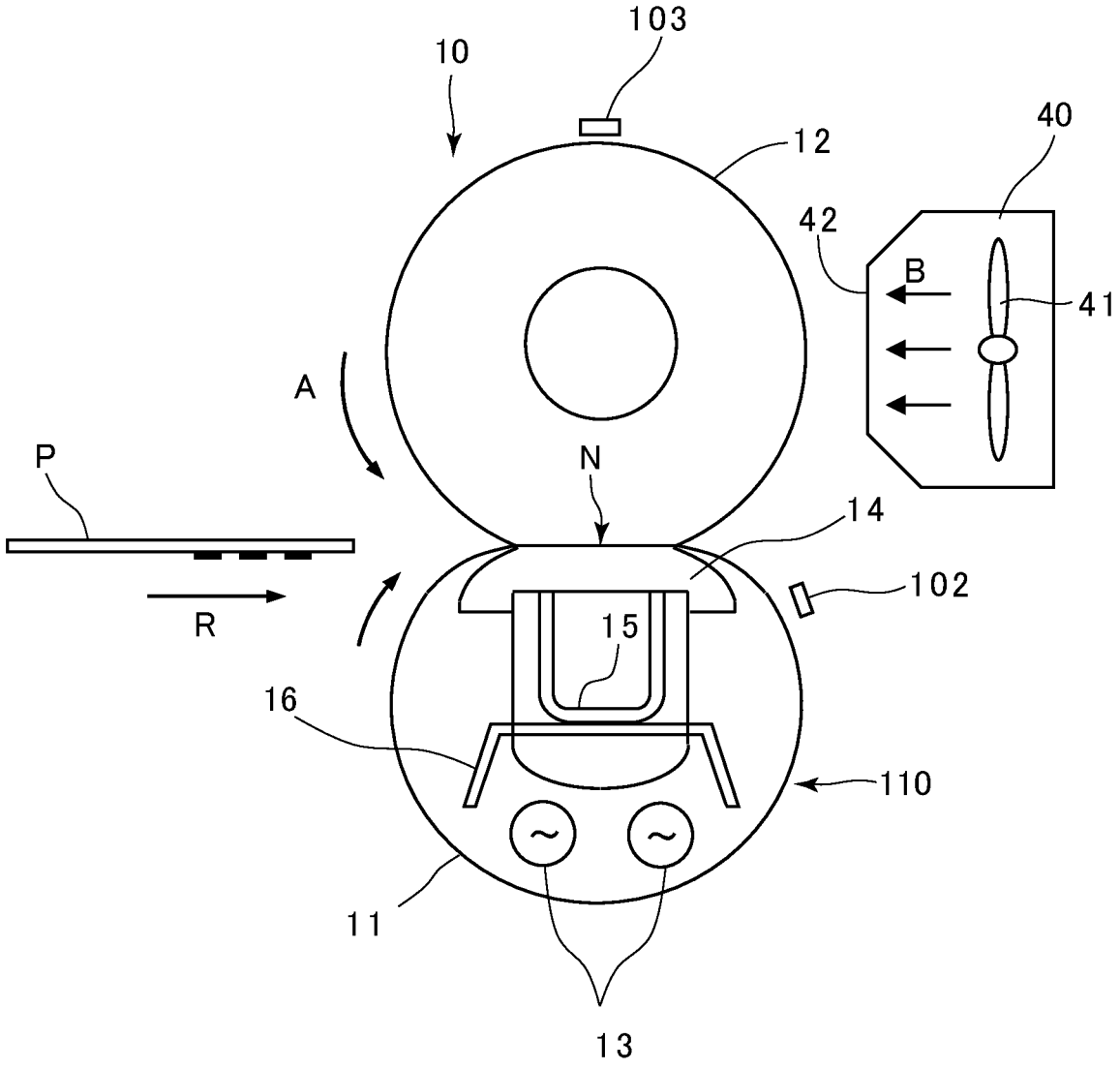
FIG. 2 is a schematic view illustrating a sheet heating unit and a cooling device.

Next, a configuration of the sheet heating unit 10 will be described with reference to FIG. 2. As illustrated in FIG. 2, the sheet heating unit 10 according to the present embodiment includes a heating belt unit 110 and a pressure roller 12. The heating belt unit 110 includes a heating belt 11, a heating belt heater 13, a nip forming member 14, a stay 15 and a reflecting plate 16. The heating belt heater 13, the nip forming member 14, the stay 15 and the reflecting plate 16 are arranged non-rotatably on an inner side of the rotatable heating belt 11. According to the present embodiment, the heating belt unit 110 is arranged on an image forming surface side of the sheet P.

The heating belt 11 serving as a first rotary member is an endless belt having an elastic layer formed on an outer surface of a cylindrical base layer made of metal or heat-resistant resin and a surface layer containing fluororesin having releasability formed on an outer surface of the elastic layer. For example, the cylindrical base layer is formed of stainless steel or polyimide and the elastic layer is formed of silicone rubber. Meanwhile, the pressure roller 12 serving as a second rotary member has an elastic layer formed for example of silicone rubber provided on an outer surface of a roller-shaped core metal made of metal, and a surface layer containing fluororesin formed on an outer surface of the elastic layer.

The heating belt 11 is heated by the heating belt heater 13 serving as a heating portion provided on the inner side of the heating belt 11. According to the present embodiment, a plurality of (two according to the present example) halogen lamps are provided as the heating belt heater 13, heating the heating belt 11 directly from the inner side. The reflecting plate 16 is provided to concentrate the light from the halogen lamp and efficiently irradiate the light to an inner circumferential surface of the heating belt 11.

The nip forming member 14 is formed in a plate shape arranged along a width direction of the heating belt 11, i.e., direction intersecting the conveyance direction of the sheet P, using a liquid crystal polymer resin having a heat-resisting property, and arranged at an opposing position to the pressure roller 12. The nip forming member 14 is pressed by a pressure mechanism not shown toward the pressure roller 12 interposing the heating belt 11 so that the heating belt 11 and the pressure roller 12 are abutted against each other to form a nip portion N for nipping and conveying the sheet P.

According to the present embodiment, the pressure roller 12 is rotated in an arrow A direction by a drive motor not shown. Then, rotating force of the pressure roller 12 is transmitted to the heating belt 11 by a frictional force generated at the nip portion N. Then, the heating belt 11 is driven to rotate by rotation of the pressure roller 12. In a state where the sheet P having passed the drying unit 3 (refer to FIG. 1) is nipped and conveyed by the rotating heating belt 11 and the pressure roller 12, the sheet P is heated and pressed at the nip portion N, by which the ink on the sheet P is further dried.

The stay 15 is a support having high rigidity that is made of metal and having a rectangular cross-sectional shape with one side open for reinforcing the nip forming member 14 to prevent deflection of the nip forming member 14 when pressure is applied to the pressure roller 12. The stay 15 is formed to have a length approximately the same as the nip forming member 14 along the width direction of the heating belt 11.

Lubricant with a heat-resisting property such as silicone oil, fluorine oil, or grease containing fluororesin particles is applied to the inner surface of the heating belt 11 to ensure a sliding property against the nip forming member 14. Such lubricants have a property in that their viscosity is reduced as the temperature increases. Therefore, in a state where the heating belt 11 is heated by the heating belt heater 13 and the temperature thereof is increased, the viscosity of the lubricant is reduced and the sliding property is increased, so that a rotational torque of a drive motor (not shown) for driving the pressure roller 12 can be suppressed to a low value.

Further, the sheet heating unit 10 includes a heating belt temperature sensor 102 and a pressure roller temperature sensor 103. The heating belt temperature sensor 102 serving as a first detection unit detects the temperature of the heating belt 11 and the pressure roller temperature sensor 103 serving as a second detection unit detects the temperature of the pressure roller 12.

The inkjet recording apparatus 1 according to the present embodiment is equipped with the cooling device 40 for cooling the pressure roller 12. The cooling device 40 serving as a cooling unit includes a cooling fan 41 and a plurality of nozzles 42. The cooling fan 41 blows air so as to form an air flow toward an arrow B direction. The nozzles 42 serving as blowout portions straighten the air sent from the cooling fan 41 so that the air is blown uniformly to the whole width direction area of the pressure roller 12.

In the case of the present embodiment, the cooling device 40 is arranged downstream in the conveyance direction of the sheet heating unit 10 so as to blow the air from the cooling fan 41 to the surface of the pressure roller 12 at a position downstream of the nip portion N in the conveyance direction. At an area upstream of the sheet heating unit 10 in the conveyance direction, warm air is blown to the sheet P by the drying unit 3 and the temperature of air tends to be higher at the area upstream of the sheet heating unit 10 than the area downstream thereof in the conveyance direction. That is, if the cooling device 40 is positioned upstream of the sheet heating unit 10 in the conveyance direction, the cooling efficiency of the pressure roller 12 by the cooling fan 41 is deteriorated by the warm air generated from the drying unit 3. Therefore, the cooling device 40 is provided downstream of the sheet heating unit 10 in the conveyance direction, which is an area farther from the drying unit 3 in the conveyance direction of the sheet P.

Control Unit

Further, the inkjet recording apparatus 1 is equipped with a control unit 200 capable of controlling the general operation of the inkjet recording apparatus 1, as illustrated in FIG. 1. Regarding the control unit 200, a control system for controlling the sheet heating unit 10 and the cooling device 40 will mainly be described based on FIG. 3 with reference to FIGS. 1 and 2. In addition to the illustrated units, various other units constituting the inkjet recording apparatus 1 and devices such as a motor and a power supply for supplying power to the various units are connected to the control unit 200, but they are not shown in the drawings and descriptions thereof are omitted since they are not the main object of the present technique.

The control unit 200 controls the operation of the inkjet recording apparatus 1, and it includes a CPU 201 (Central Processing Unit) and a memory 202, for example. The memory 202 is composed of a ROM (Read Only Memory) and a RAM (Random Access Memory), for example. The memory 202 can store various programs such as a "cooling control processing" (refer to FIG. 6 described later) for controlling the cooling device 40, various data such as predetermined temperature differences and number of sheets, or image information entered from an external device such as a computer or a document reading apparatus. The CPU 201 can execute various programs stored in the memory 202, and the various programs are executed to control the operations of various units of the inkjet recording apparatus 1. Further, the memory 202 is capable of temporarily storing data such as a computation processing result accompanying the execution of various programs. For example, the CPU 201 can count the number of sheets P passing the drying unit 3 and conveyed to the sheet heating unit 10 continuously, and to store the number in the memory 202.

A continuous image forming job refers to a period from the start of image forming operation to completion of the image forming operation based on a print signal for forming an image continuously to a plurality of sheets. Specifically, it refers to a period from pre-rotation, i.e., preparation operation prior to image forming operation, after receiving a print signal, i.e., input of image forming job, to post-rotation, i.e., operation after image forming operation, and includes the image forming period and intervals between sheets. For example, if a job is entered continuously after one job, the jobs are recognized as one continuous image forming job.

The heating belt temperature sensor 102 is connected to the control unit 200 via an input/output interface, and the control unit 200 controls the heating belt heater 13 based on the temperature acquired from the heating belt temperature sensor 102. During a continuous image forming job, the control unit 200 controls supply of power from a power supply not shown to the heating belt heater 13 based on the temperature detected by the heating belt temperature sensor 102 and maintains the temperature of the heating belt 11 to a target temperature. Therefore, the sheet P is conveyed to the nip portion N in a state where the temperature of the heating belt 11 is maintained at a target temperature.

Further, the pressure roller temperature sensor 103 is connected to the control unit 200 via an input/output interface. The control unit 200 controls whether to blow air from the cooling fan 41 toward the pressure roller 12 based on the temperature acquired from the heating belt temperature sensor 102 and the temperature acquired from the pressure roller temperature sensor 103. As described in detail later (refer to FIG. 6), turning on and off of the cooling fan 41 is controlled based on the temperature difference between the temperature of the heating belt 11 detected by the heating belt temperature sensor 102 and the temperature of the pressure roller 12 detected by the pressure roller temperature sensor 103.

Figure 4A:
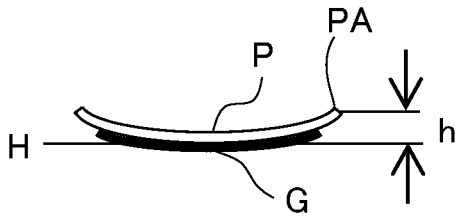
FIG. 4A is an explanatory view of curling of a sheet, illustrating a state of the sheet after passing through a printing device.
Figure 4B:
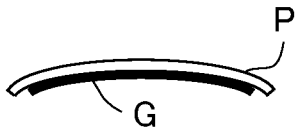
FIG. 4B is an explanatory view of curling of the sheet, illustrating a state of the sheet after passing through a drying unit.
Figure 4C:
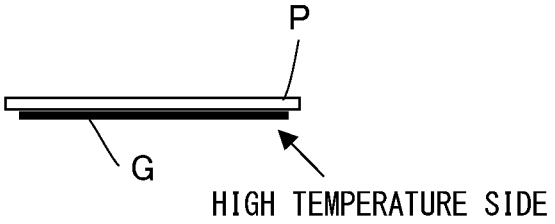
FIG. 4C is a view illustrating a state of the sheet after the curl has been straightened by the sheet heating unit.

Next, an example of a curled sheet P is illustrated in FIGS. 4A to 4C. FIG. 4A illustrates a state of the sheet after passing the printing unit 2, FIG. 4B illustrates a state of the sheet after passing the drying unit 3, and FIG. 4C illustrates a state of the sheet after passing the sheet heating unit 10. In FIGS. 4A to 4C, reference G denotes an ink.

After an image has been printed to the sheet P, moisture from the ink G is penetrated from the image forming surface side, and the moisture content on the image forming surface side tends to become higher than the side opposite therefrom (referred to as the opposite surface). Therefore, the sheet P having passed the printing unit 2 may be curled as illustrated in FIG. 4A so that the opposite surface side having a relatively high moisture content is expanded and the center area in the conveyance direction is raised on the image forming surface side, according to which the image forming surface side is protruded. The amount of curl formed on the sheet P can be acquired by placing the sheet on a horizontal surface H with the protruded side facing the horizontal surface H and measuring a vertical distance h between a leading edge PA of the sheet P in the conveyance direction and the horizontal surface H.

After being dried by the drying unit 3, the sheet P may be curled as illustrated in FIG. 4B so that the center area in the conveyance direction is raised on the opposite surface side, according to which the opposite surface side is protruded. This is due to the warm air being blown from the drying unit 3 to the image forming surface side of the sheet and the image forming surface side being contracted in the process of having the moisture on the image forming surface side where the moisture content is relatively high being evaporated and reduced.

Generally, after passing the sheet heating unit 10, as illustrated in FIG. 4C, the curl of the sheet P is straightened and the amount of curl of the sheet P is reduced. This is due to the following reasons. When the sheet P is nipped and conveyed at the nip portion N, the temperature of the image forming surface side becomes higher than the opposite surface side due to the heating performed by the heating belt 11, and moisture may be evaporated. However, the moisture contained in the sheet P is not easily evaporated from the image forming surface side which is pressed by the heating belt 11, so that it is evaporated from the opposite surface side. Thereby, the moisture content on the opposite surface side is increased. Thereafter, moisture is evaporated from the opposite surface side after the sheet P had passed through the nip portion N, so that the opposite surface side is contracted, and the curl of the sheet P is straightened.

A curl straightening effect of the sheet P by the sheet heating unit 10 will be described with reference to FIG. 5. The curl straightening effect of the sheet P refers to a magnitude of the curl that can be created by the sheet heating unit 10, in other words, an intensity of deformation in a vertical direction of the sheet P in a state where the sheet P is pressed. The magnitude of the curl that can be created by the sheet heating unit 10 is acquired by the following process. A sheet P that is not curled is passed through the sheet heating unit 10 in a state where the temperatures of the heating belt 11 and the pressure roller 12 are adjusted in advance. Then, the sheet P having passed through the sheet heating unit 10 is placed on a flat surface, and after elapse of a predetermined time, such as 10 seconds, the amount of curl of the sheet P, that is, the vertical distance h (refer to FIG. 4A), is measured. The amount of curl of the sheet P obtained in this manner corresponds to the intensity in which the sheet P is deformed in the vertical direction when the sheet P is pressed.

Figure 5:
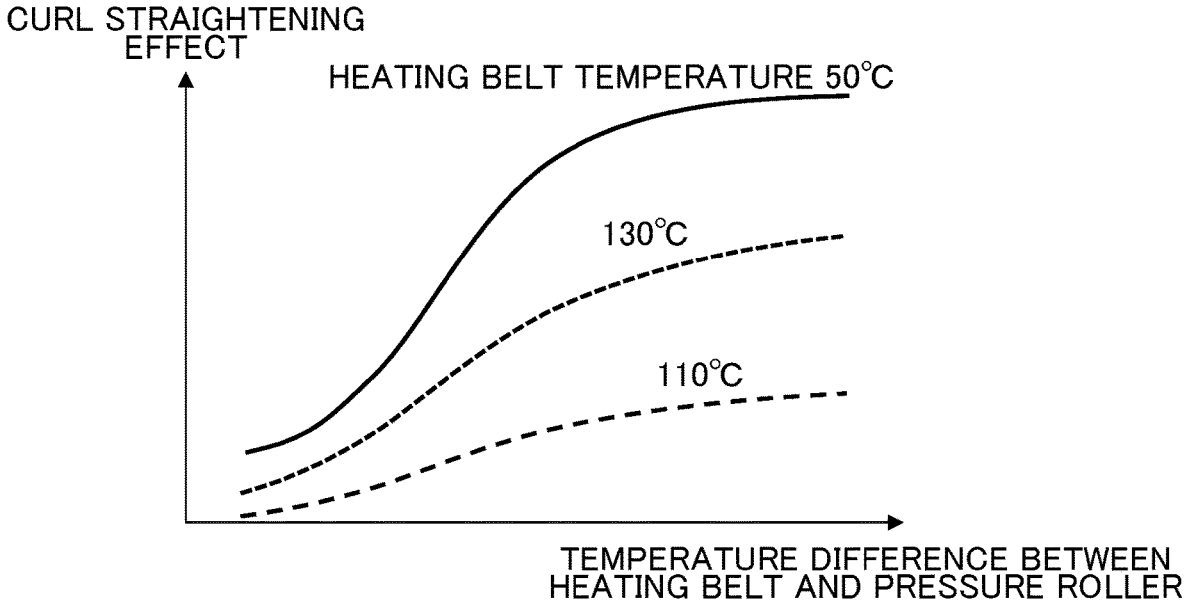
FIG. 5 is a view illustrating a curl straightening effect by the sheet heating unit.

As can be recognized from FIG. 5, greater curl straightening effect of the sheet P can be achieved as the temperature of the heating belt 11 increases or as the temperature difference between the heating belt 11 and the pressure roller 12 increases. Therefore, during execution of the image forming job for forming an image on the sheet P, it is important to maintain the temperature difference between the heating belt 11 and the pressure roller 12 to achieve a stable curl straightening effect of the sheet P.

Hitherto, however, in the configuration including both the drying unit 3 and the sheet heating unit 10 as described above, it was difficult to continuously straighten the curl on the sheet P. That is, in a case where both the drying unit 3 and the sheet heating unit 10 are used, the curl of the sheet P tends to be increased due to the drying of the ink by the drying unit 3. In order to straighten such curl, it is necessary to increase the temperature difference between the heating belt 11 and the pressure roller 12 and to maintain such temperature difference. Hitherto, however, the temperature of the pressure roller 12 tended to rise due to the heat of the heating belt 11 and the temperature of the sheet P that has been heated by the drying unit 3, so that the temperature difference required to straighten the curl of the sheet P could not be maintained, and so it was difficult to continuously straighten the curl on the sheet P.

Therefore, according to the present embodiment, the cooling fan 41 of the cooling device 40 described above is subjected to on/off control based on the temperature difference between the temperature of the heating belt 11 and the temperature of the pressure roller 12, so that the curl of the sheet P can be straightened continuously by the sheet heating unit 10. Now, a "cooling control processing" (cooling mode) of the first embodiment for realizing the technique is described based on FIG. 6 with reference to FIGS. 1 to 3. The "cooling control processing" is executed by the control unit 200 at a matched timing with the starting of the continuous image forming job.

Figure 6:
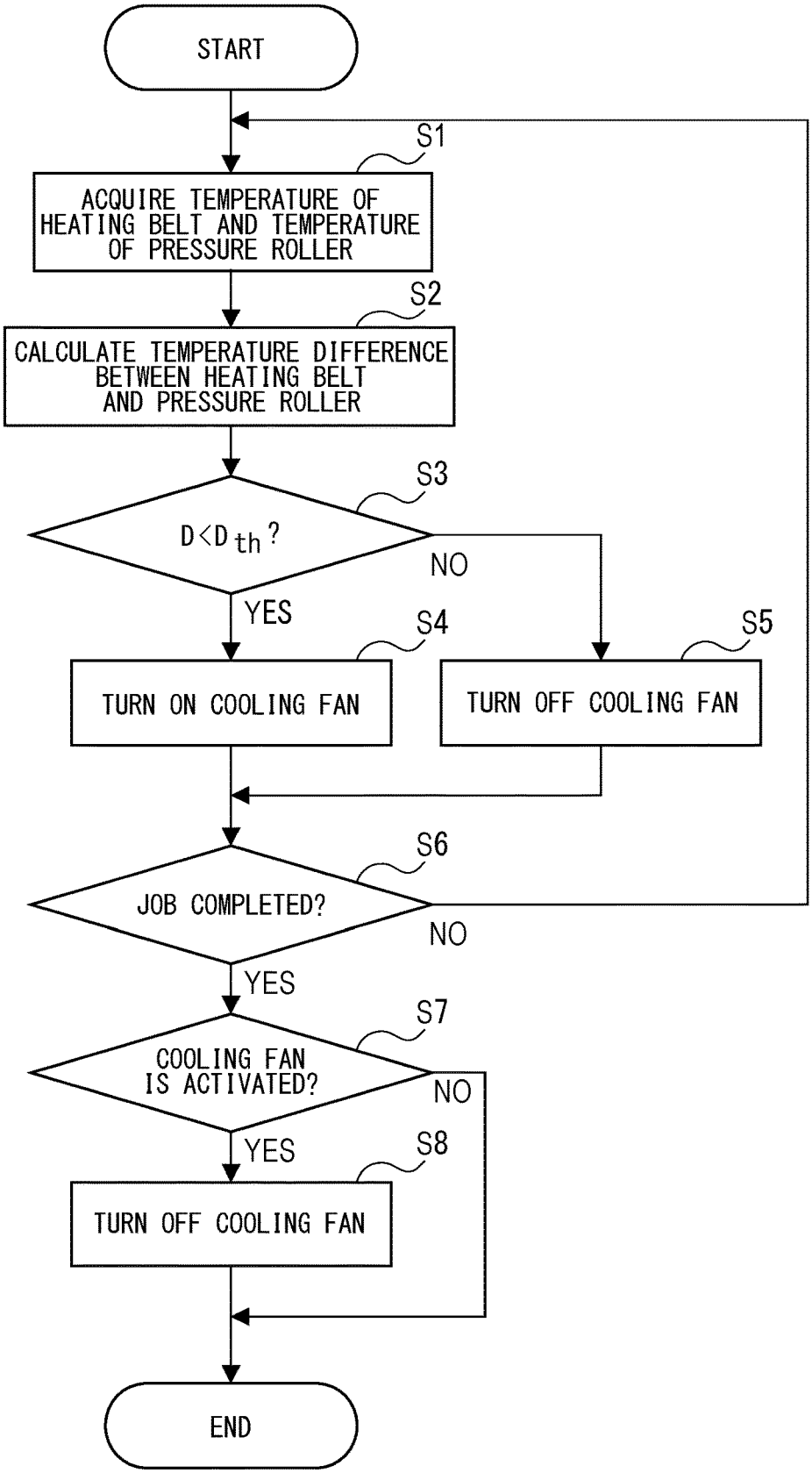
FIG. 6 is a flowchart illustrating a cooling control processing according to a first embodiment.

As illustrated in FIG. 6, the control unit 200 acquires a temperature of the heating belt 11 detected by the heating belt temperature sensor 102 and a temperature of the pressure roller 12 detected by the pressure roller temperature sensor 103 (S1). After acquiring the temperature of the heating belt 11 and the temperature of the pressure roller 12, the control unit 200 acquires the temperature difference between the temperatures (S2). Then, the control unit 200 determines whether the acquired temperature difference (D) is smaller than a threshold (Dth) (S3).

If the temperature difference (D) is smaller than the threshold (Dth) (S3: YES), the control unit 200 turns on and activates the cooling fan 41 of the cooling device 40 to cool the pressure roller 12 (S4). That is, if the temperature difference becomes too small compared to the threshold, the effect of straightening the curl of the sheet P cannot be achieved, so that the cooling fan 41 is activated beforehand to lower the temperature of the pressure roller 12. Along with the lowering of temperature of the pressure roller 12, the temperature difference between the heating belt 11 and the pressure roller 12 is increased and becomes equal to or greater than the threshold, so that the effect of straightening the curl of the sheet P is maintained. In this state, it is preferable that the control unit 200 rotates the cooling fan 41 at a first rotation speed in a case where the temperature difference is a first temperature difference and rotates the cooling fan 41 at a second rotation speed that is faster than the first rotation speed in a case where the temperature difference is a second temperature difference that is smaller than the first temperature difference. In other words, it is preferable that the cooling ability of the cooling fan 41 is enhanced in a case where the temperature difference is small, i.e., second temperature difference, compared to a case where the temperature difference is greater, i.e., first temperature difference, so that the temperature difference is returned to be equal to or greater than the threshold in a relatively short period of time. Thereafter, the control unit 200 advances to the process of step S6.

Meanwhile, if the temperature difference (D) is equal to or greater than the threshold (Dth) (S3: NO), the control unit 200 turns off the cooling fan 41 to stop the operation and stops cooling of the pressure roller 12 (S5). That is, in the current stage, the temperature difference between the heating belt 11 and the pressure roller 12 is maintained to a temperature difference capable of achieving the effect of straightening the curl of the sheet P, so that it is a waste of power if the temperature of the pressure roller 12 is lowered further by continuously activating the cooling fan 41 regardless thereof. Thus, uneconomical consumption of power is suppressed by turning off the cooling fan 41. Thereafter, the control unit 200 advances to the process of step S6.

The control unit 200 determines whether to end the continuous image forming job as a process of step S6. If the continuous image forming job is not to be ended (S6: NO), the control unit 200 returns to the process of step S1 described above and repeats the processes of steps S1 to S5 again. Meanwhile, if the continuous image forming job is to be ended (S6: YES), the control unit 200 determines whether the cooling fan 41 is activated (S7). If the cooling fan 41 is activated (S7: YES), the control unit 200 turns off the cooling fan 41 (S8) and ends the cooling control processing. If the cooling fan 41 is not activated (S7: NO), the control unit 200 ends the cooling control processing.

An example of the present embodiment in which the temperature control of the pressure roller 12 is enabled by the cooling device 40 as described above will be compared with a comparative example that is not equipped with the cooling device 40 so that the temperature control of the pressure roller 12 is difficult. The transition of temperature of the heating belt 11 and the temperature of the pressure roller 12 of a case where image is formed continuously to A4-size normal sheets for the present embodiment and the comparative example is illustrated in FIG. 7A, and the transition of temperature difference of the heating belt 11 and the pressure roller 12 corresponding thereto is illustrated in FIG. 7B.

Figure 7A:
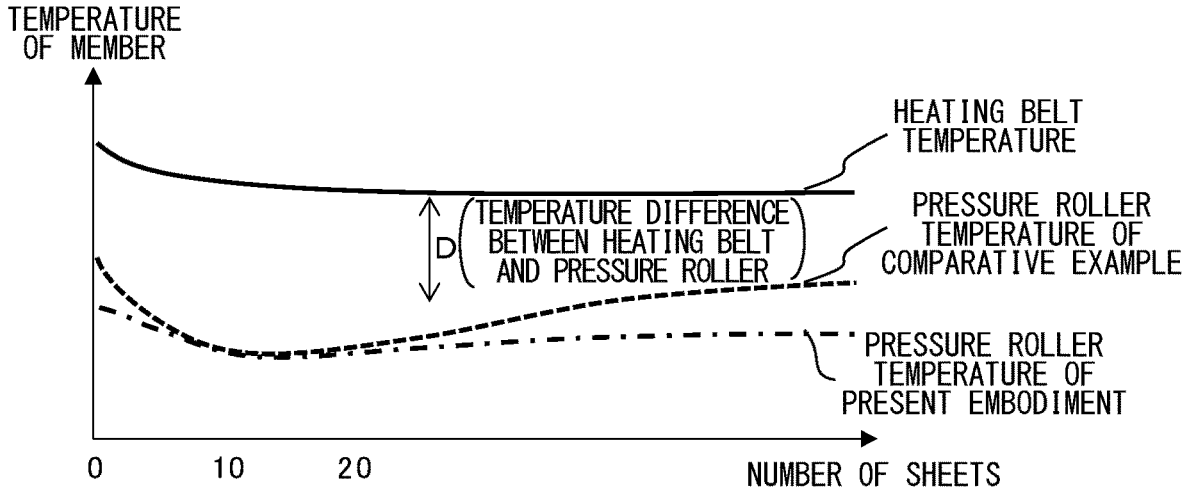
FIG. 7A is a view illustrating a transition of temperature of a heating belt and a pressure roller during continuous printing.
Figure 7B:
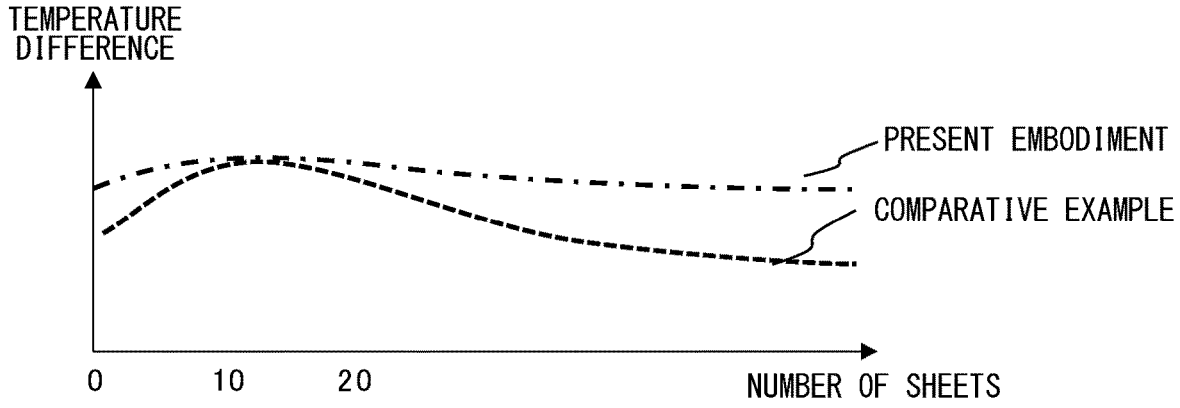
FIG. 7B is a view illustrating a transition of temperature difference between the heating belt and the pressure roller during continuous printing.

As can be recognized from FIGS. 7A and 7B, in the comparative example, in a state where a continuous image forming job is performed by operating the sheet heating unit 10, the temperature difference of the heating belt 11 and the pressure roller 12 becomes maximum at a point of time when image has been formed to over ten sheets P. Thereafter, as the number of sheets P to which image has been formed increases, the temperature of the pressure roller 12 rises, and the temperature difference with the heating belt 11 that is maintained to an approximately constant temperature reduces. In contrast, according to the present embodiment, if the temperature difference falls below the threshold as described above, the cooling fan 41 is turned on and the rising of temperature of the pressure roller 12 is suppressed. Therefore, compared to the comparative example, the temperature difference will not be reduced excessively and will be maintained at a high state. Thereby, according to the present embodiment, a temperature difference that is required to straighten the curl can be maintained during the continuous image forming job, so that the curl of the sheet P can be continuously straightened.

According to the "cooling control processing" of the first embodiment, the "threshold (Dth)" (refer to S3 of FIG. 6) used for comparison with the temperature difference can be set to different temperatures (temperature differences) according to a grammage of the sheet P. For example, as the grammage of the sheet P increases, the stiffness of the sheet P increases, and the sheet P is less easily curled. Therefore, it is preferable to use a first threshold in a case where the grammage of the sheet P is a first grammage and to use a second threshold that is smaller than the first threshold in a case where the grammage of the sheet P is a second grammage that is greater than the first grammage. Further, the temperature of the heating belt 11 can be set to a first temperature in a case where the grammage of the sheet P is the first grammage and to set a second temperature lower than the first temperature in a case where the grammage of the sheet P is the second grammage that is greater than the first grammage.

As described, according to the present embodiment, the cooling fan 41 is activated, i.e., turned on, prior to a state where the temperature difference between the temperature of the heating belt 11 and the temperature of the pressure roller 12 becomes so small that the effect of straightening the curl of the sheet P cannot be achieved, and cools the pressure roller 12. As the pressure roller 12 is cooled by the cooling fan 41, the temperature difference between the temperature of the heating belt 11 and the temperature of the pressure roller 12 is maintained to a temperature difference capable of achieving the effect of straightening the curl of the sheet P. In other words, the rising of temperature of the pressure roller 12 is suppressed so that the temperature difference between the temperature of the heating belt 11 and the temperature of the pressure roller 12 is not reduced, and the temperature difference is maintained to a high value equal to or greater than the threshold (Dth) required to straighten the curl of the sheet P. Therefore, according to the present embodiment, the curl of the sheet P can be straightened continuously during the continuous image forming job.

Second Embodiment

Figure 3:
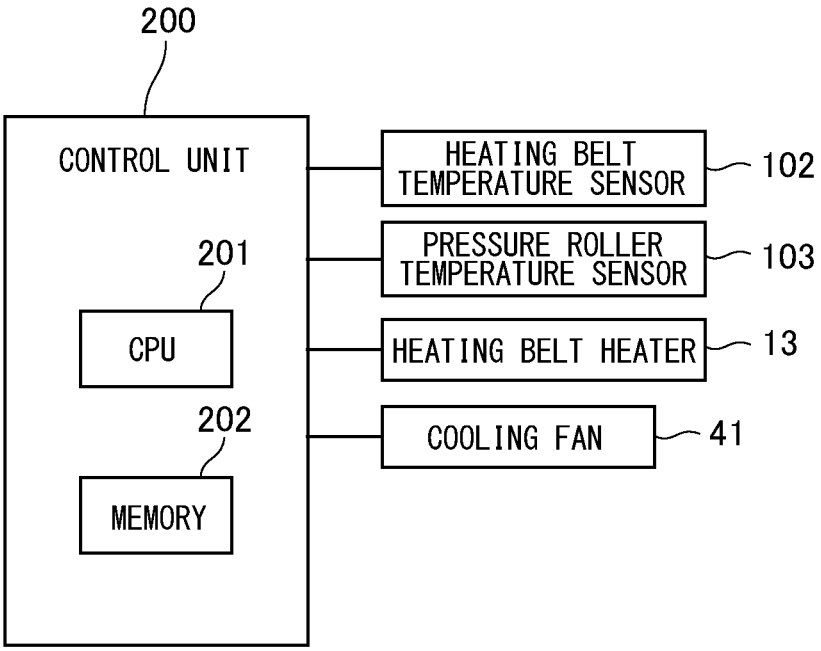
FIG. 3 is a control block diagram illustrating a control unit.

Next, a "cooling control processing" according to a second embodiment will be described based on FIG. 8 with reference to FIGS. 1 to 3. In the following description regarding the cooling control processing of the second embodiment, the same steps as the cooling control processing according to the first embodiment described above (refer to FIG. 6) are denoted with the same step numbers to simplify the description. According to the present embodiment, it is not necessary to provide the pressure roller temperature sensor 103 described above.

Figure 8:
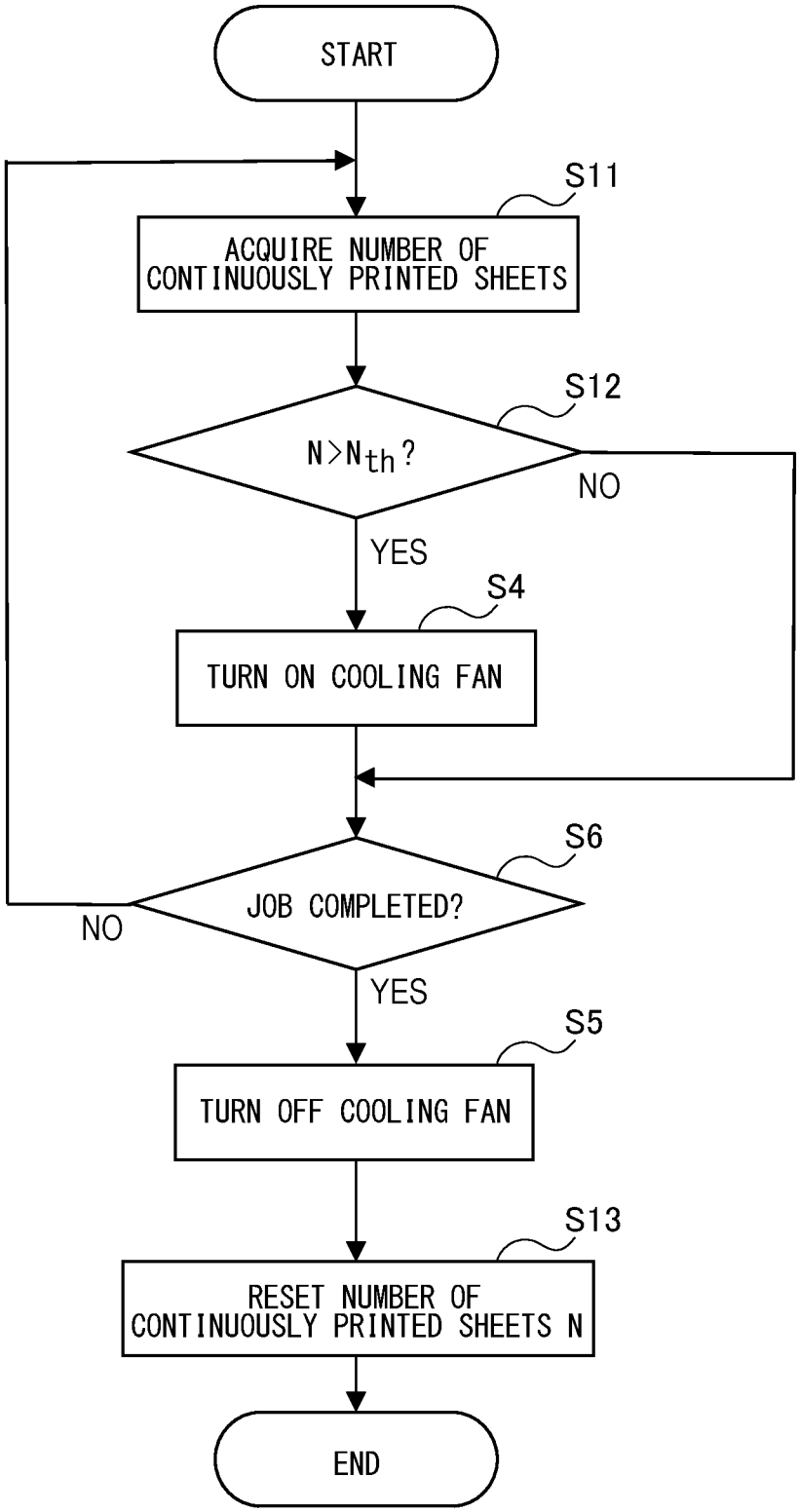
FIG. 8 is a flowchart illustrating a cooling control processing according to a second embodiment.

As illustrated in FIG. 8, the control unit 200 acquires the number of sheets P passing the drying unit 3 and continuously conveyed to the sheet heating unit 10 that had been counted and stored in the memory 202, that is, the number of sheets P (referred to as the number of continuously printed sheets) to which image has been formed continuously (S11). Then, the control unit 200 determines whether the number of continuously printed sheets (N) that had been acquired exceeds a threshold (Nth) (S12).

If the number of continuously printed sheets (N) exceeds the threshold (Nth) (S12: YES), the control unit 200 turns on and activates the cooling fan 41 of the cooling device 40 to cool the pressure roller 12 (S4). That is, if the number of continuously printed sheets exceeds the threshold, the heat transmitted from the heating belt 11 accumulates in the pressure roller 12, according to which the temperature of the pressure roller 12 rises, and the temperature difference with the heating belt 11 is likely to be reduced. If the temperature difference becomes too small, sufficient effect of straightening the curl of the sheet P cannot be achieved, as have been described earlier, so that the cooling fan 41 is activated prior to that state to reduce the temperature of the pressure roller 12. Accompanying the reduction of temperature of the pressure roller 12, the temperature difference between the heating belt 11 and the pressure roller 12 is increased, so that the effect of straightening the curl of the sheet P is continuously achieved. Thereafter, the control unit 200 advances to the process of step S6.

Meanwhile, if the number of continuously printed sheets (N) has not exceeded the threshold (Nth) (S12: NO), the control unit 200 advances to the process of step S6 without performing on/off control of the cooling fan 41.

As the process of step S6, the control unit 200 determines whether to end the continuous image forming job. If the continuous image forming job is not ended (S6: NO), the control unit 200 returns to the process of step S11 described earlier and repeats the processes of steps S11, S12 and S4 again. Meanwhile, if the continuous image forming job is to be ended (S6: YES), the control unit 200 turns off the cooling fan 41 if the cooling fan 41 is activated (S5). Then, the control unit 200 clears the number of continuously printed sheets stored in the memory 202 to zero sheets and starts counting again (S13). Thereafter, the control unit 200 ends the cooling control processing.

In the "cooling control processing" of the second embodiment, the "threshold (Nth)" used for comparison with the number of continuously printed sheets (refer to S12 of FIG. 8) may be set to different numbers according to the grammage of the sheet P. For example, as the grammage of the sheet P increases, the stiffness of the sheet P increases, and the sheet P is less easily curled. Therefore, it is preferable to use a first threshold in a case where the grammage of the sheet P is a first grammage and to use a second threshold that is greater than the first threshold in a case where the grammage of the sheet P is a second grammage that is greater than the first grammage. Further, if the pressure roller temperature sensor 103 is provided, the threshold can be set to a different number of sheets based on the temperature of the pressure roller 12 at the start of the continuous image forming job. For example, if the temperature of the pressure roller 12 at the start of the continuous image forming job is high, the threshold should be set to a small value since the number of continuously printed sheets before the temperature difference reaches a value where the effect of straightening the curl of the sheet P cannot be easily achieved is small.

As described, also according to the present embodiment, cooling of the pressure roller 12 by the cooling fan 41 can be performed before the temperature difference between the temperature of the heating belt 11 and the temperature of the pressure roller 12 becomes so small that the effect of straightening the curl of the sheet P cannot be easily achieved. Therefore, during the continuous image forming job, the temperature difference between the temperature of the heating belt 11 and the temperature of the pressure roller 12 can be maintained to a temperature difference capable of achieving the effect of straightening the curl of the sheet P, so that the curl of the sheet P can be continuously straightened.

Other Embodiments

The inkjet recording apparatus 1 can be an apparatus of the type in which an ink is discharged onto a continuous sheet being wound into a roll to form an image thereto. However, in such a case, a cutter unit equipped with a mechanical cutter must be arranged between the printing unit 2 and the drying unit 3 in the conveyance direction of the sheet P to cut the continuous sheet after printing using the cutter unit to a given length.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-123994, filed on Jul. 20, 2020, which is hereby incorporated by reference herein in its entirety.

What is claimed is:

1. An inkjet recording apparatus comprising:

a conveyance portion configured to convey a sheet;

a printing portion configured to discharge ink and form an image on a first surface of the sheet;

a drying portion configured to blow warm air to the first surface of the sheet to which the image has been formed by the printing portion to dry ink;

a first rotary member arranged downstream of the drying portion in a conveyance direction of the sheet and is in contact with the first surface of the sheet;

a heating portion configured to heat the first rotary member;

a second rotary member abutted against the first rotary member and configured to form a nip portion that is configured to nip and convey the sheet having passed the drying portion and apply heat and pressure to the sheet;

a first detection unit configured to detect a temperature of the first rotary member;

a second detection unit configured to detect a temperature of the second rotary member;

a cooling unit configured to cool the second rotary member; and a control unit configured to execute a cooling mode of activating the cooling unit in a state where a temperature difference between the first rotary member and the second rotary member is smaller than a threshold.

2. The inkjet recording apparatus according to claim 1, wherein the cooling unit comprises a cooling fan, and a blowout portion configured to blow air from the cooling fan toward the second rotary member at a position downstream of the nip portion in the conveyance direction.

3. The inkjet recording apparatus according to claim 2, wherein during execution of the cooling mode, the control unit is configured to rotate the cooling fan at a first rotation speed in a case where a temperature difference between the first rotary member and the second rotary member is a first temperature difference, and to rotate the cooling fan at a second rotation speed that is faster than the first rotation speed in a case where the temperature difference between the first rotary member and the second rotary member is a second temperature difference that is smaller than the first temperature difference.

4. The inkjet recording apparatus according to claim 1, wherein the threshold is a first threshold in a case where a grammage of the sheet is a first grammage, and is a second threshold that is greater than the first threshold in a case where the grammage of the sheet is a second grammage that is greater than the first grammage.

5. An inkjet recording apparatus comprising:

a conveyance portion configured to convey a sheet;

a printing portion configured to discharge ink and form an image on a first surface of the sheet;

a drying portion configured to blow warm air to the first surface of the sheet to which the image has been formed by the printing portion to dry ink;

a first rotary member arranged downstream of the drying portion in a conveyance direction of the sheet and is in contact with the first surface of the sheet;

a heating portion configured to heat the first rotary member;

a second rotary member abutted against the first rotary member and configured to form a nip portion that is configured to nip and convey the sheet having passed the drying portion and apply heat and pressure to the sheet;

a cooling unit configured to cool the second rotary member; and a control unit configured to execute a cooling mode of activating the cooling unit in a state where the number of sheets to which the image has been continuously formed is greater than a threshold during execution of an image forming job.

6. The inkjet recording apparatus according to claim 5, wherein the cooling unit comprises a cooling fan, and a blowout portion configured to blow air from the cooling fan toward the second rotary member at a position downstream of the nip portion in the conveyance direction.

7. The inkjet recording apparatus according to claim 5, wherein the threshold is a first threshold in a case where a grammage of the sheet is a first grammage, and is a second threshold that is greater than the first threshold in a case where the grammage of the sheet is a second grammage that is greater than the first grammage.

* * * * *